United States Patent [19]

Brunton

[11] 4,317,570

[45] Mar. 2, 1982

[54] GAME WITH SIMULATED GAME PIECE

[75] Inventor: Robert E. Brunton, Baxter, Australia

[73] Assignee: Brunton & Brunton Pty. Ltd., Melbourne, Australia

[21] Appl. No.: 62,436

[22] Filed: Jul. 30, 1979

[30] Foreign Application Priority Data

Jul. 28, 1978 [AU] Australia ..... PD5273

[51] Int. Cl.[3] ..... A63F 9/14; A63F 3/00

[52] U.S. Cl. ..... 273/246; 273/289; 273/283; 434/60

[58] Field of Search ..... 273/246, 258, 259, 288, 273/289, 277, 284, 283, 254; 46/219, 204

[56] References Cited

U.S. PATENT DOCUMENTS

| | | | |
|---|---|---|---|
| 2,052,035 | 8/1936 | Potter | 273/94 R |
| 2,757,933 | 8/1956 | Gilmour | 273/254 |
| 3,206,887 | 9/1965 | Eyler et al. | 46/17 |
| 3,692,310 | 9/1972 | Martin | 273/284 X |
| 3,926,437 | 12/1975 | Moe et al. | 273/289 X |
| 4,182,516 | 1/1980 | Gill | 273/258 |

FOREIGN PATENT DOCUMENTS

| | | | |
|---|---|---|---|
| 340173 | 9/1959 | Switzerland | 273/246 |
| 808937 | 2/1959 | United Kingdom | 273/246 |
| 1174676 | 12/1969 | United Kingdom | 273/243 |

OTHER PUBLICATIONS

Nicholas Palmer, *The Comprehensive Guide to Board Wargaming*, ©1977, p. 16.

*Primary Examiner*—Richard T. Stouffer
*Assistant Examiner*—Scott L. Brown
*Attorney, Agent, or Firm*—Sughrue, Mion, Zinn, Macpeak & Seas

[57] ABSTRACT

A game in which players can engage in a simulated contest such as a sail boat race, a glider race or a snow buggy race, and having a set of cards layable side by side to define a course and simulated vehicles consistent with the type of race. The vehicles are moveable over the course in accordance with the particular rules of the race and the cards have markings thereon which indicate "conditions" that are likely to exist in the particular type of race.

21 Claims, 6 Drawing Figures

GAME WITH SIMULATED GAME PIECE

Figure 1:
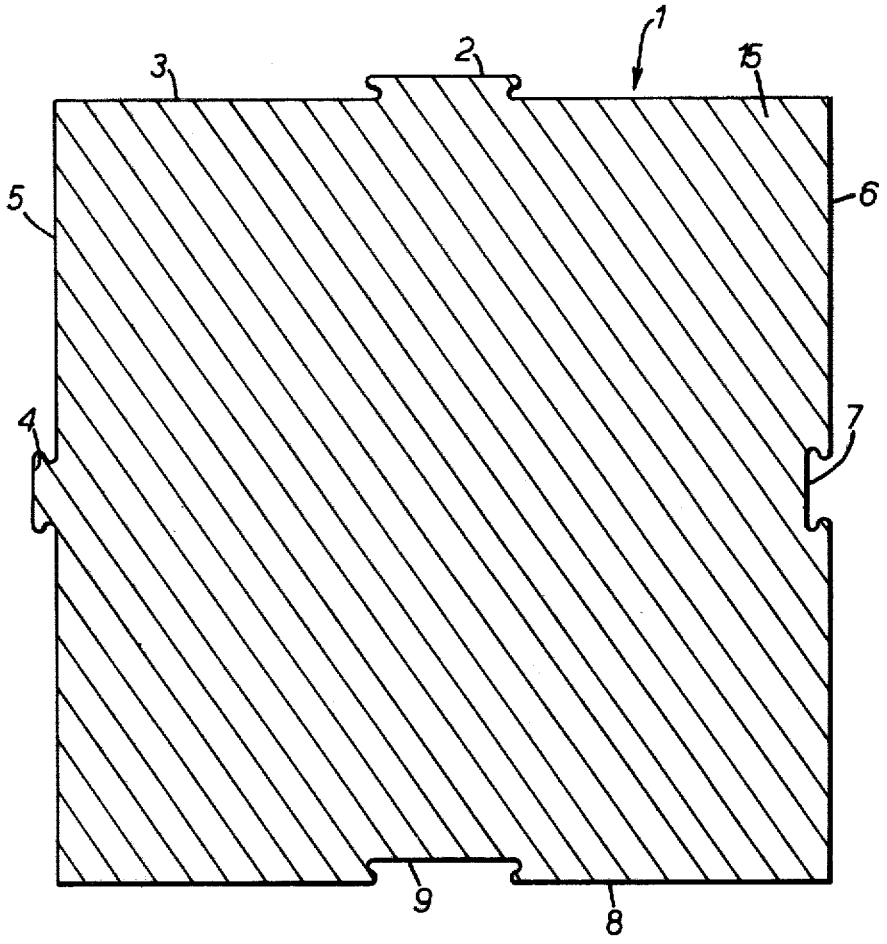

This invention relates to improvements in or relating to a game and in particular, a game comprising a simulated contest such as a race. This invention also includes the various artifacts for use in such a game.

According to one aspect of the present invention a set of cards for use to simulate the course and "going" in a simulated contest comprises a plurality of sheets arranged to be laid side by side to define a surface over which a simulated contestant must travel, each sheet having means to determine its position relative to the adjacent side of an adjoining sheet and having means to indicate the "going" which is assumed to have effect over said sheet. The expression "going" is used herein to signify a set of relevant conditions applicable in the vicinity of the surface. For example, in a simulated yacht race the going may be represented by one or more of conditions such as wind speed and direction, tides, course hazards and the like.

According to a further aspect of the present invention, there is provided a simulated vehicle for movement across a surface which constitutes the course of a race, said vehicle comprising means to facilitate its alignment in at least two directions relative to a simulated racing condition and also including indicator means to measure movement of said vehicle along its longitudinal axis relative to the flat surface without reference to the surface.

According to a still further aspect of the present invention, there is provided a game in the form of a simulated race, said game comprising a set of cards in the form of sheets, each sheet being adapted to be laid side by side to define an area of the course of the race, each sheet having means to determine its position relative to the adjacent side of an adjoining sheet and having means to indicate a simulated going or condition of the course over that sheet. and a plurality of simulated vehicles which constitute the participants in the race, each vehicle having means to align itself with the course of the race and indicator means to determine its movement along the course of the race without reference to the race course.

Preferably the race is a sailing race and the vehicle comprises a sailing boat. Flat sheets define the course of the race and each sheet is provided with means to indicate the strength and direction of a simulated wind or current. The simulated sailing boat is preferably provided with means to enable the boat to be aligned with the wind direction indicated on the sheet on which the simulated boat stands.

Each sheet is preferably square shaped so that it has sides of equal length, an adjoining sheet being arranged to be laid side by side any one of the sides of the square. Advantageously, some of the sheets possess a variation in the direction and strength of the simulated wind or current.

The sides of the sheets are preferably provided with interengaging male and female coupling means, the size of the coupling means being arranged so that a sheet can only be positioned in one position adjacent the side of an adjoining sheet. Alternatively, other techniques can be employed to determine the position of one sheet adjacent the side of an adjoining sheet such as indicator means on said sheets which have to be lined up when the sheets are laid side by side.

In a preferred embodiment the wind or current strength and direction is designated by a plurality of parallel lines on the surface of each sheet. The spacing of the lines may be varied to indicate a variation in wind strength or alternatively, lines of differing colours could be used on separate sheets to indicate a variation in wind or current strength.

The means to indicate movement of the vehicle without reference to the surface of the course of the race is preferably provided by a rotatable member secured to said vehicle and driven by contact of said vehicle on the surface of said course, said rotatable member having markings which indicate the degree of movement of said vehicle. In a preferred embodiment said rotatable means comprises a caterpillar track having equally spaced markings on its surface. Two small spaced apart rollers are preferably secured to the vehicle to be rotatable therewith and said caterpillar track is driven by said rollers. The means to align said vehicle in at least two directions relative to a simulated racing condition preferably comprises a pair of mutually perpendicular score lines provided on a surface of said vehicle which is parallel to the surface of said course.

According to a still further aspect of the present invention a game in the form of a simulated race comprises a simulated course over which the race is to be held, said course having means to indicate variations in the "going" of the course and a plurality of simulated race participants, each participant arranged to be displaceable around the course subject to the "going", each participant having means to measure its movement along the course without reference to the course.

Although the games, set of cards and simulated racing vehicles described above are preferably for use in a sailing game, this invention is not limited to sailing games. Other games based on a race over a course are also envisaged as falling within the scope of this invention such as snow or water skiing races, land sailing and sand buggy races.

Figure 2:
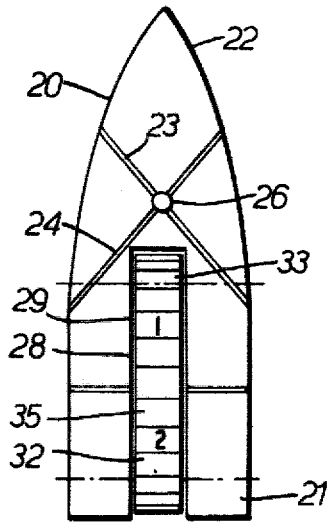
Figure 3:
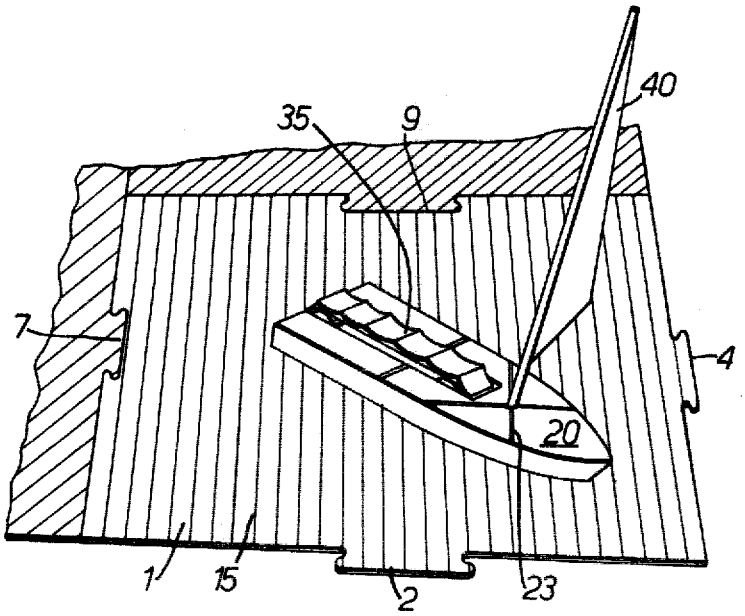
Figure 4:
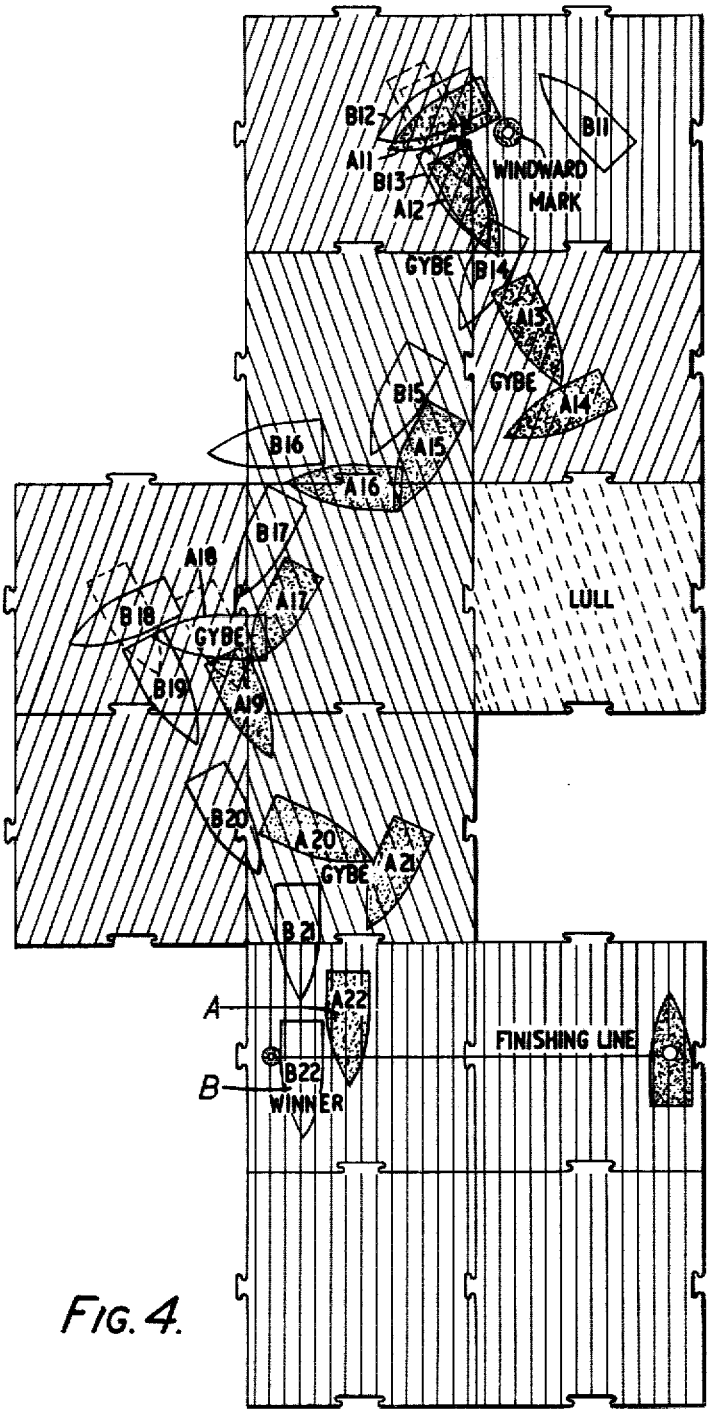
Figure 5:
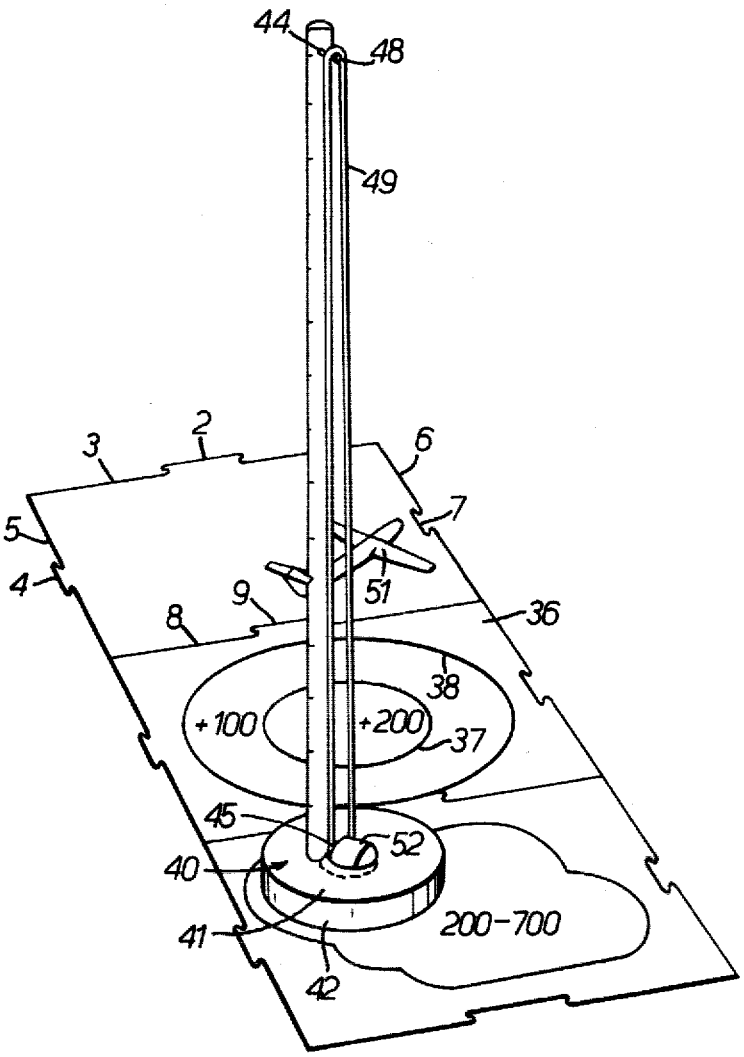
Figure 6:
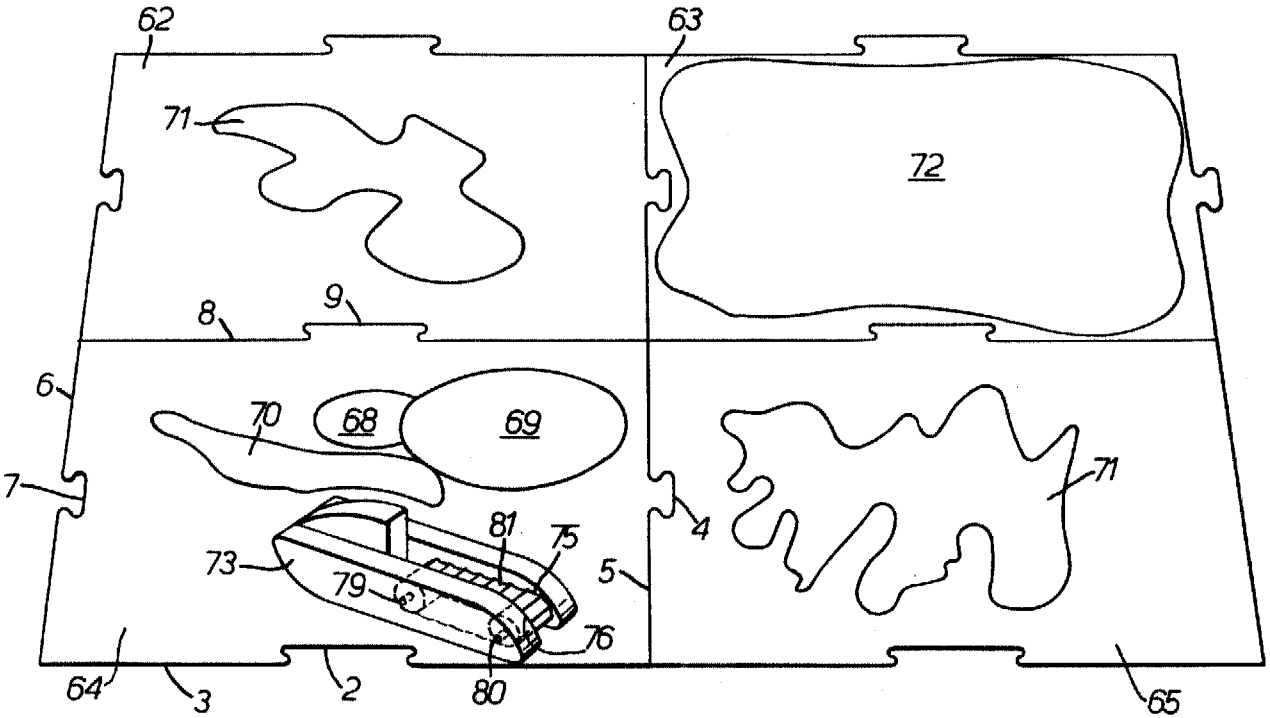

Embodiments of the present invention will now be described by way of example only, with reference to the accompanying drawings, in which:

FIG. 1 is a plan view of one of a set of cards for use in a simulated sailing race of the present invention, FIG. 2 is a plan view of the simulated boat for use with the set of cards of FIG. 1, FIG. 3 is a perspective view of the simulated boat of FIG. 2 and the set of cards of FIG. 1, FIG. 4 is a plan view of a game course made up from the cards of FIG. 1 and having marked thereon a record of moves made during part of a race run in accordance with the invention, FIG. 5 is a perspective view of a simulated glider and one set of cards for use in a simulated gliding race of the present invention, and FIG. 6 is a perspective view of a simulated snow buggy and one set of cards for use in a simulated snow buggy race of the invention.

A game of a simulated sailing race comprises a set of cards which comprise flat sheets which may be laid side by side to define the course of the race and a plurality of simulated sailing vessels which can be moved along the course and simulate the participants of the race. The game also includes a device for ascertaining when one of two adjacent vessels is 'blanketed' or 'back winded'.

One of the set of cards is illustrated in FIG. 1 and comprises a flat square shaped plastics or cardboard card 1 having an integrally formed male projection 2 at the mid point of one of the sides 3 of the card and another smaller male projection 4 against another side 5 of the card. A side 6 opposite to side 5 is provided with an inwardly projecting cut-out 7 of substantially the same profile as the male projecting member 4. The final side 8 of the card opposite side 3 is provided with a similarly shaped female cut-out 9 to the male projection 2. The male and female interfitting projections and cut-outs are arranged so that the cards can be laid side by side and coupled together in one position, since the protrusion 2 cannot fit within the female cut-out 7 and the protrusion 4 will not accurately fit within the female cut-out 9. Accordingly, a card can only be interlocked to the adjacent card in one position. However, the rules of the game are such that the card can be attached to any side of an adjacent card, simple rotation of the card to be attached to bring into line corresponding keying members enables this interconnection. All the cards are provided with parallel lines which are drawn on the upper surface of the cards, these lines represent wind directions and the direction of the lines vary from card to card. Furthermore, wind strength is indicated by the colour of the lines and in a preferred embodiment, white lines constitute a wind of half strength to black lines. Another alternative would be to vary the spacing of the lines so that closer lines represent stronger wind than lines that are spaced further apart.

Although not shown, other of the cards may possess other indications such as a starting line or turning buoy or even obstructions, such as rocks or shallow water. Due to the variation in the direction and wind strengths on the cards, there are a number of possibilities of fitting the cards together thereby defining different race courses in which the direction and wind strength vary throughout the course. Depending on the rules of the game the cards may initially be placed together to define the race course before the race commences or alternatively, the cards can be shuffled and placed upside down and each player takes a card in turn thereby introducing a random change in the course during the progression of the race. In a further alternative, the players can be dealt a number of cards which they periodically present to an opponent. This enables the player to choose the course and sailing condition of his opponent.

FIG. 2 illustrates part of a simulated sailing vessel which constitutes a participant in a race. The vessel comprises a base member 20 which constitutes the hull of the boat and is preferably manufactured from transparent Perspex. The base 20 is preferably formed to give the visual appearance of a boat having a stern 21 and bow 22. The base member 20 is substantially flat and has an upper surface 25 which when the vessel is resting on a card extends parallel to the upper surface of the card. A pair of score lines or grooves 23 and 24 are cut in the Perspex to extend mutually perpendicular to each other to cross each other at their mid points as shown in FIG. 2. The grooves 23 and 24 constitute a means for aligning the boat with a wind direction shown by the lines 15 on the cards. A small hole is provided at the cross-over point between the lines 23 and 24 for location of a small simulated sail (not shown). The sail can be pivoted relative to the hole 26 so that during the game the relative position of the sail to the board can be selected thereby ensuring that the wind direction is apparent to all participants.

The Perspex base or hull 20 is also provided with a cut-out 28 having parallel sides 29 and 30 which extend substantially parallel to the sides of the boat. The cut-out 28 is positioned so that it is in the mid span of the boat and extends from a position approximately adjacent the middle of the boat to the stern 21. The cut-out also extends right through the hull of the boat. There is provided at each end of the channel 28 a pair of rollers 32 and 33 which are located in the hull of the boat. The rollers 32 and 33 are rotatable relative to the boat and are arranged to support a rubber caterpillar track 35 which extends between the rollers. The diameter of the rollers is such that when the boat is rested on the surface of one of the cards, the lower surface of the caterpillar track 35 abuts this surface so that when the boat is moved along the surface of the card this movement causes the track to grip the surface and cause rotation of the rollers and track. By providing four equally spaced markings on the caterpillar track the amount of movement in a direction along the longitudinal axis of the boat, that is a line drawn through the bow to the stern of the boat can be determined. Four equally spaced markings are used so that a full move comprises moving from one marking to return to the same marking and therefore half and quarter moves can easily be calculated. To align the simulated boat 20 with a wind direction, the boat is simply pivoted about the front roller 33 until the score line 23 or 24 is aligned with the wind direction on the card.

The device for assessing 'blanketing' or 'back winding' comprises a thin sheet of transparent Persex on which is marked a line which is aligned with the longitudinal axis of one boat and a curved area marked on the Perspex sheet either behind or in front of this line. To use the covering template, the template is simply positioned vertically above one boat with the line aligned with the boat's axis and then an assessment is made to see whether the sail of an adjacent boat lies within the area bordered by the curved line.

To further illustrate the operation of the game, reference is made to the accompanying set of rules which follow herewith by way of example of one way of playing the game.

(1) The boats are sailed over the course cards which are taken in a random manner, as required, from the top of a face down pack, hence providing unpredictable variations in wind direction and strength.

The normal race is comprising sailing from a start line, round a buoy and returning to the start line. Players take alternative moves.

2(a) The Basic Move (On black lined cards)

The boat is moved across the cards so that the caterpillar track makes one complete rotation i.e. from numeral 1 shown on the upper surface of the track back to numeral 1.

(b) The Basic Move (On white lined course cards)

The white lined course cards indicate an area of lesser wind strength. Therefore, the basic move that starts on these cards is for only on half a rotation of the caterpillar track, i.e. numeral 1 to numeral 3.

(3) Sailing To Windward

One or other of the tracking angle lines (the grooves 23 or 24) on the boat (port or starboard tacks) is to be lined up with the wind direction lines 15 printed on the course cards. The boat may not be pointed higher into the wind than indicated by the tacking angle lines, but may "Bear-Away" if required.

(4) Tacking

Tacking is achieved by pivotting the boat on its front roller 33 on to the opposite tack, so that the opposite tacking angle line lines up with the wind direction lines on the card. The boat then moves one half of the basic move. Alternatively one half move can be taken before pivotting.

(5) Crossing Tacks

When boats are crossing tacks, starboard tack has the right of way. The boat on port tack must either tack or bear-away to clear a boat on starboard tack. A boat on port tack cannot complete a move which leaves it in a position that would inhibit an oncoming boat on starboard tack.

(6) Starting

Starting manoeuvres are carried out on the two cards which carry the printed starting line and two additional cards which have parallel wind lines, placed immediately behind the starting line. The players (up to 4 players) can commence by placing their boats anywhere on these four cards, but then they must complete six complete basic moves before finally crossing the starting line to start the race, (on the seventh move). The act of tacking and taking the half move counts as a basic move. If a boat starts prematurely or is forced across the line and cannot get back before completing the sixth move then it must obey yacht racing rules and sail back around an end of the starting line.

(7) The Course Cards

After starting, when a player knows that his boat will move off the card it is on during the execution of the next move he can take a card off the top of the pack and place it so that the positioning lugs engage and it is in a position for his boat to sail onto. The tacking angle is dictated by the wind angle of the card that the move commenced on. After completion of the move the boat is turned to sail on the new wind direction if necessary. After having taken and placed a card the player is not committed to move on to it. If it is an unfavourable wind shift he may decide to tack or bear-away and take another card and place it adjacent the first card. Both cards, however, must remain as part of the course. When the cards have been sailed over and all boats are clear of them they should be periodically picked up and shuffled at random back into the pack.

(8) "Blanketting" and "Back Winding"

A player may slow down his opponent to half a normal move (half rotation on black line card, quarter rotation on white card) by positioning his boat so as to have his opponent's boat within the areas shown on the covering template.

(9) Length of Course

The card with the windward mark (buoy) on it is placed with the windward mark centered on the centre of the starting line, an agreed upon number of card widths away (minimum of 3 widths)

(10) Sailing Down Wind

After rounding the windward mark, any remaining cards that have been placed on the course and have not been used by any following boats must be shuffled back into the pack. Then the boat returning down wind can head directly to the finish line, placing cards in front as needed. However, if it sails on to a white card then it is slowed down to half a move.

Any change of direction down wind, no matter how slight is regarded as a "GYBE" and penalised by half a move.

(11) Blanketting Down Wind

If a player can position his boat so as to place his opponents mast within the area shown on the covering template, then that boat is slowed down to one half the applicable move.

(12) Finishing

To finish a boat must simply sail over the finish line. If the race is close then the moves should be "Played Out" at the finish; whichever boat is furthest over the finish line after all players have had their last move is the winner.

There are many variations and modifications to the rules falling within the scope of the invention as described above. Furthermore, the invention is not restricted to a sailing game; other races such as snow or water skiing can be simulated within the scope of this invention.

This invention produces a particularly simple, yet realistic simulated sailing race which the participants can vary the rules whatever type of sailing race they wish to participate in. The method of playing the game on the whole utilises the well known principles and ethics of sailing and therefore, can be useful both as a game and as a teaching aid for young or inexperienced sailors.

FIG. 3 illustrates the inter-engagement of the set of cards of FIG. 1 in one part of a course of a sailing race. The simulated sailing boat is shown sailing to windward. Groove 23 of the simulated sailing boat is aligned substantially parallel to the wind direction lines as printed on the course card.

FIG. 4 is a plan view of a game course made up from the cards of FIG. 1 and illustrates a part of a race between simulated sailing boats A and B. The boats move in sequence and the figure provides a record of the moves made during the part of the race.

A second embodiment of the present invention relates to a game of a simulated gliding race and is shown in FIG. 5. The game comprises a set of cards which may be laid side by side to define the course of the race and a plurality of simulated gliders which can be moved along the course and simulate the participants of the race. The cards illustrated in FIG. 5 are similar in construction to the cards previously described in relation to the first embodiment and illustrated in FIG. 1. The same reference numerals are used in FIGS. 1 and 5 in respect of the same features. The cards in the gliding race are provided with markings on the upper surface which are characteristic of conditions that a glider may encounter during a race. Different cards are provided with different markings. As an example, card 36 is provided with two concentric circles 37 and 38, the region contained by circle 37 and the annular region defined between circles 37 and 38 corresponding to "thermals", i.e. regions of ascending or descending air. The amount and direction of the particular "thermal" defined by each region is preferably indicated by numerals in the particular region. Another example is card 41 which is provided with a region 50 which corresponds to a "cloud". The vertical extent of the "cloud" is preferably indicated by numerals shown in the region of the "cloud". For instance, in the particular arrangement shown in FIG. 5, cloud 50 extends between 200 and 700 feet.

Although not shown other of the cards may possess other indications such as a starting line and a target area.

The simulated glider 42 comprises a Perspex annular disc 40 having flat upper and lower surfaces 41 and 42. A solid Perspex tube 43 extends vertically from the upper surface of the annular disc 40, and a pin 44 extends outwardly from tube 43 near the free end of the tube. Pin 44 carries a pulley wheel 48. Perspex tube 43 is provided with graduations at regular intervals along its length each graduation corresponding to an interval of height. In the particular arrangement shown in FIG. 5 the maximum "altitude" the simulated glider can reach is 1500 feet.

A spring loaded axle (not shown) extends between cavities (not shown) in the annular disc 46. The axle carries a rubber wheel 52 which is positioned in the centre of the annular disc 40, and such as to engage the surface of the card on which the disc 40 rests. Wheel 52 has a pulley wheel 45 connected to it. An endless belt 49 extends between the pulley wheel 48 and the pulley wheel 45. A simulated glider 51 is fixed to the belt 49.

It will be readily appreciated that when the annular disc is located on a card of the set of cards as shown in FIG. 5 and a horizontally directed force is applied to the annular disc to move the disc in a forward direction, the wheel 47 will rotate by virtue of frictional driving engagement with the card and the simulated glider will move downwards.

To further illustrate the operation of the game reference is made to the accompanying set of rules which follow herewith by way of example of one way of playing the game:

1. OBJECT OF GAME

The normal race comprises "gliding" from a starting line to a target area. Players take alternate moves. The successful player is the first player who is able to "land" his simulated glider in the target area. By the term "land" is meant that the glider 51 connected to the pulley belt 49 of the simulated glider will be at minimum altitude, i.e. adjacent the upper surface 47 of the annular disc.

2. LENGTH OF COURSE

The card provided with the target area is placed an agreed upon number of cards widths away from the card provided with the starting line.

3. THE COURSE CARDS

As the game progresses cards are taken in random fashion as required, such as from the top of a face down pack, hence providing unpredictable variations in air conditions. Before each move, when a player is aware that his simulated glider will move off the card it is on during the execution of the next move, the player can take a card or cards off the top of the pack and place the card of cards so that the positioning lugs engage and the card is or the cards are in a position for his simulated glider to move thereon.

4. BASIC MOVE

Before start of play the simulated glider 51 is positioned at maximum altitude. A player may move his simulated glider in more than one direction in a single move and as far as he wishes to, so long as the simulated glider has altitude. For instance, in the particular arrangement shown in FIG. 4, a player's first move toward a target may be for a distance over the surface of the cards sufficient to reduce the simulated glider's altitude from 1500 feet to 200 feet. However, the player must not subsequently move the simulated glider over a distance sufficient to lose all the gliders altitude, unless the simulated glider is being moved in to land on the target area.

5. AIR CONDITIONS (a) "Thermals"-In order to gain altitude a player may move his simulated glider to reset in the region of an upward "thermal". The player may increase the altitude of his simulated glider in increments corresponding to the value assigned to the "thermal", but must miss his turn to move over the course in such case.

Similarly, in order to lose altitude a player may land in a downward "thermal". The player may reduce the altitude of his simulated glider in increments corresponding to the value assigned to the "thermal", again missing his turn to move over the course in such case.

(b) Clouds are taken to provide a barrier to a simulated glider in situations where the altitude of the simulated glider is within the assigned altitude range of the cloud. When this situation arises the player may, for instance, "fly" the simulated glider around the outside of the cloud or move to an upward "thermal" to gain sufficient altitude to clear the cloud, or move to a downward "thermal" to lose sufficient altitude to "go under" the cloud.

6 GENERAL

International gliding rules relating to avoiding other gliders are applicable.

A third embodiment of the present invention relating to a simulated snow buggy race is shown in FIG. 6. The game comprises a set of cards which may be laid side by side to define the course of the race and a plurality of simulated snow buggies which can be moved along the course and simulate the participants of the race. The cards 62, 63, 64, 65 and 66 illustrated in FIG. 6 are similar in construction to the cards described in the previous embodiments, and the same reference numerals are used for the same features. The upper surfaces of the cards show markings characteristic of geographic features that a snow buggy would encounter when travelling over a course of this type. For instance, card 64 shows trees 68 and 69, and a pool of water 70, card 65 shows a rock outcrop 71, and card 63 shows a region of soft snow 72.

The simulated snow buggy comprises a snow buggy-shaped vehicle 73 which has a cutout portion 74 having parallel sides 75 and 76. Rollers 77 and 78 are positioned on respective axles 79 and 80 fixed between parallel sides 76 and 75. The rollers are rotatable relative to the snow buggy and are arranged to support a rubber caterpillar track 81 which extends between the rollers. The construction of the caterpillar track is similar to that described in relation to the sailing boat described previously. The rules of the race outlined in respect of the previously described boat race may be modified to suit the particular requirements of the race. Briefly, the rules may take the following form:

1. The object of the game is for a player to move his snow buggy from a starting position to a finishing position before an opponent can move his snow buggy from the starting position to the finishing position.

2. Each player in turn moves his snow buggy a set distance measured by the rotation of the caterpillar track 81.

3. The player must change the direction of his snow buggy in order to avoid obstacles, for instance trees, rocks etc.

4. A player may move his snow buggy directly across a pool of water provided that in the space of one move, the snow buggy clears the pool of water.

5. If a player must cross soft snow, the distance the player may move in any move is half the normal distance.

This invention has been advanced by way of example only and many other modifications and variations may be made thereto without departing from the spirit and scope of the invention as defined in the appended claims.

I claim:

1. A simulated game piece defining a participant for use in a game, said simulated game piece being a simulated glide which is attached to an endless loop which runs about two end rollers one positioned above the other and supported from a support member engagable on and movable over a horizontal surface, a rotatable member being provided coupled to the lower of said rollers to frictionally engage the said surface when the support member is displaced thereover to rotate the rotatable member and drive said lower end roller for driving said loop to cause vertical movement of the said simulated glider.

2. A game in the form of a simulated contest, said game comprising a set of cards in the form of sheets, each sheet being adapted to be laid side by side to define an area of the course of the contest, each sheet having means to determine its position relative to the adjacent side of an adjoining sheet and having means to indicate a simulated "going" or condition of the course over the sheet, and a plurality of simulated vehicles which constitute the participants in the contest, each vehicle having means to align itself with the course of the contest and indicator means to indicate its movement along the course of the contest without reference to the contest course, said indicator means of each said vehicle comprises a movable member carried by the respective said vehicle and arranged to be driven by contact of the respective said vehicle on the upper surface of a said sheet, said movable member having markings which indicate the degree of movement of the respective said vehicle.

3. A game in the form of a simulated contest comprising a simulated course over which the race is to be held, said course having means to indicate variations in the "going" of the course and a plurality of simulated race participants, each participant being arranged to be displaceable around the course subject to the "going", each participant having means operable to move an indicator portion thereof in the direction normal to the course in response to movement of the participant thereacross, each said indicator portion being in the form of a simulated glider coupled to an endless loop which extends about end rollers one positioned above the other and carried by a support portion of the respective participant, one said end roller of each participant being arranged to be driven by a friction roller which engages the upper surface of the said course during movement of that participant thereacross in a forward direction whereby to drive said endless loop of that participant such that said simulated glider of that participant is moved downwardly in proportion to the said movement across said surface by virtue of consequent downward movement of an upright run of the said loop on which that simulated glider is located.

4. A game apparatus for playing a simulated contest comprising a set of cards in the form of sheets, each sheet being adapted to be laid side-by-side to form a simulated course of the contest in which the sides of the sheets are provided with elements of inter-engaging male and female means, the elements at each side being arranged so that a said sheet can only be positioned in one position adjacent the side of an adjoining sheet with said elements at the then adjacent sides of the joining sheets inter-engaged, said sheets having means to indicate variations in the "going" of the course, and a plurality of simulated race participants, each participant being arranged to be displaceable around the course subject to the "going", each participant having means to measure its displacement along the course without reference to the course.

5. A game apparatus as claimed in claim 4 wherein each sheet has means to determine its position relative to the adjacent side of an adjoining sheet.

6. A game apparatus as claimed in claim 4 wherein said means to measure displacement of a participant comprises a movable member carried by the participant and arranged to be driven by contact with a surface defining said course as the participant is displaced around the course, whereby to effect movement of the movable member in proportion to the displacement of the participant, and means associated with said movable member for indicating the degree of movement of the movable member.

7. A game apparatus as claimed in claim 6 wherein each said participant comprises a simulated vehicle running on a ground wheel or endless track and the said means to indicate the "going" comprises means including simulated ground obstacles over said course.

8. A game apparatus as claimed in claim 7 wherein said movable member of each participant in use contacts said surface defining said course, for frictional driving of the movable member pursuant to said displacement of the participant, each said movable member being mounted to its said participant so that the point or points of contact thereof with the surface defining said course are confined for said movement substantially only in a front to rear direction of the participant along which direction said displacement of the participant in use occurs.

9. A game apparatus as claimed in claim 8 in which each said movable member commprises an endless flexible loop member having equally spaced markings on its surface which runs around two spaced apart end rollers mounted on its said participant.

10. A game apparatus as claimed in claim 9 wherein said end rollers are positioned for rotation about axes transverse to said front to rear direction and at front rear locations on the respective participant, each said loop member being of generally flat cross-section and arranged whereby in use to engage said surface defining said course at a plurality of points on a lower surface of a lower run of the loop member, said points being spaced both laterally and longitudinally of the participant.

11. A game apparatus as claimed in claim 10 wherein each said participant is provided with means for aligning the participant relative to the course.

12. A game apparatus as claimed in claim 11 wherein said means for aligning each said participant is arranged to permit selective orientation of the said front to rear direction relative to one other direction defined by the "going" at a particular location on said surface when occupied by the participant.

13. A game apparatus as claimed in claim 12 wherein each said means for aligning is arranged to permit said selective orientation of said front-to-rear direction at either of two angular positions relative to said one direction.

14. A game apparatus as claimed in claim 13 wherein said participants comprise simulated yachts and said means for aligning comprise, on each simulated yacht, a pair of mutually perpendicular lines provided on a surface of that simulated yacht which in use of the simulated yacht is parallel to said surface defining said course.

15. A game apparatus as claimed in claim 14 wherein said lines are normal to each other and at an angle substantially 45° to said front-to-rear direction.

16. A game apparatus as claimed in claim 15 wherein the means to indicate a simulated "going" comprises means on at least some of said sheets to indicate the strength and direction of simulated wind or current, the last mentioned direction comprising said one direction.

17. A game apparatus as claimed in claim 16 in which each sheet is square so that it has sides of equal length and said sheets having said means to indicate strength and direction include sheets on which different wind or current strengths and/or directions are indicated.

18. A game apparatus as claimed in claim 17 wherein said means to indicate the strength and direction include parallel lines.

19. A game apparatus as claimed in claim 8 wherein each said participant includes a part which is operatively associated with said movable member whereby to vary the position of the part vertically in dependence on displacement of the participant in its front-to-rear direction over said course, said vertical movement then being proportional to the displacement of the participant.

20. A game apparatus as claimed in claim 19, wherein said part is in the form of a simulated glider, said movable member comprising a friction wheel and said means to measure displacement further includes an endless loop which carries said glider and which extends about end rollers one positioned above the other and carried by a support portion of the respective participant, one said end roller of each participant being arranged to be driven by said friction wheel which wheel is positioned to engage the surface defining said course during displacement of the participant thereacross in said front-to-rear direction, whereby to drive said endless loop of the participant such that said simulated glider of the participant is moved downwardly in proportion to said displacement across said surface defining said course, by virtue of consequent downward movement of an upright run of the said loop on which that simulated glider is located.

21. A game apparatus as claimed in claim 20, wherein the said means to indicate the "going" comprises indications on at least some of said sheets of regions of simulated wind updraft and of simulated cloud banks.

* * * * *